US005868629A

United States Patent [19]

VanDuyn et al.

[11] Patent Number: 5,868,629

[45] Date of Patent: Feb. 9, 1999

[54] BALL LIFT DEVICE AND METHOD

[75] Inventors: David Russell VanDuyn, Golden; Steven Wayne Stuart, Arvada, both of Colo.

[73] Assignee: AMF Bowling, Inc., Golden, Colo.

[21] Appl. No.: 17,579

[22] Filed: Feb. 3, 1998

[51] Int. Cl.[6] ..... A63D 1/08

[52] U.S. Cl. ..... 473/111; 473/109

[58] Field of Search ..... 473/54, 106, 109, 473/110, 111, 112

[56] References Cited

U.S. PATENT DOCUMENTS

| | | | |
|---|---|---|---|
| 2,019,607 | 11/1935 | Hedenskoog | 273/47 |
| 2,682,405 | 6/1954 | Huck | 273/49 |
| 2,931,651 | 5/1960 | Zuercher | 473/111 |
| 3,109,648 | 11/1963 | Anderson et al. | 273/49 |
| 3,109,649 | 11/1963 | Anderson et al. | 473/111 |
| 3,127,172 | 3/1964 | Troiano et al. | 473/111 |
| 3,313,540 | 4/1967 | Untiedt | 273/49 |
| 3,479,029 | 11/1969 | Zuercher et al. | 273/49 |
| 5,449,327 | 9/1995 | Heddon et al. | 473/110 |

*Primary Examiner*—William M. Pierce
*Attorney, Agent, or Firm*—Fields and Johnson, P.C.

[57] ABSTRACT

The ball lift device includes an improved track structure for stabilizing a bowling ball along a path of travel or guide path as it is lifted within the device. The device includes a means for lifting the ball by use of a pair of rotating V wheels and a drive means which rotates the V wheels through a drive belt which is driven by a motor. The V wheels are housed within a frame which has an entrance point for receiving the bowling ball to be lifted, and an exit point which ejects the bowling ball at a specified height. A guide support or single track structure defines the path of travel in which the ball is lifted through the device. The guide support includes a guide support bracket and a wear strip mounted over the bracket. A pair of side wear strips extend along the path of travel and are positioned so as to laterally stabilize the bowling ball as it is lifted along the guide support. The method of lifting includes the steps of providing a lifting device, introducing the ball into the lifting device along a path of travel, contacting the ball with a guide support assembly along a center line of the path of travel, and lifting the ball wherein the ball maintains contact against the guide support along the center line and is stabilized with at least one side wear strip.

13 Claims, 3 Drawing Sheets

18
B
P
W
14
43
42
10
54
CL
50
72
12
69
52
52
20
54
38
22
64
34
26
30
18
72
28
64
74
24
18
18
18
B
32
20
70
68
32
14
18
45
16
36
44
40
5
B
18
74
12
CL
16
5
18
44
68
16
67
46
18
CA
78
16
W
74
48
46
70
CL
B
L 68
70
W
P
P

BALL LIFT DEVICE AND METHOD

TECHNICAL FIELD

This invention relates to a device and method of lifting an object and, more particularly, to a ball lift device and method for lifting a bowling ball to a desired level which may be incorporated within a ball return system of a bowling lane.

BACKGROUND ART

A number of prior art devices exist which are used in a ball return system for returning a bowling ball to a bowler. Common to each of these devices is some means by which the bowling ball enters a lifting device, is lifted to a desired level, and then is ejected from the device to a waiting bowler.

One representative example of a prior art device is U.S. Pat. No. 5,449,327 to Heddon, et al. The system disclosed in this reference includes a conventional power lift device which includes a pair of tubular track members which receive and guide the bowling ball as it is lifted to a specified height.

U.S. Pat. No. 3,127,172 to Troiano, et al. discloses a mechanism for returning bowling balls from the alley pit to the players' area. The mechanism includes a pair of vertically disposed wheels and a guide way including a pair of tubular rods which are spaced equidistant from the outer peripheral edge of the wheels. A bowling ball is introduced in the space between the guide way and the lower wheel. The spinning action of the lower wheel and the upper wheel carries the bowling ball upwards to a specified height along the pair of rods where the ball is then ejected onto a platform.

U.S. Pat. Nos. 3,109,648 to Anderson, et al., and 3,313,540 to Unteidt disclose bowling ball lift mechanisms including a pair of continuous rod-like track members which secure a bowling ball against lower and upper rotating wheels. The wheels cause the bowling ball to be lifted along the track members. The track members are arcuately curved concentrically about the axis of rotation of each of the wheels.

U.S. Pat. Nos. 3,109,649 to Anderson, et al., and 3,479,029 to Zuercher, et al. both disclose bowling ball lift mechanisms which make use of a pair of tubular track members to engage the bowling ball as it is lifted to a specified height by a rotating lift wheel.

U.S. Pat. No. 2,682,405 to Huck discloses a ball lift apparatus including a pair of track members arranged in an S-shaped pattern. A conveyor belt disposed in a vertical position is spaced from the track members. The bowling ball enters one end of the apparatus and is engaged by the conveyor belt. The track members are spaced from the conveyor belt such that a bowling ball is caught between the conveyor belt and track members in order to lift and deposit the ball to a specified height.

Examples of prior art commercial devices include the Century C-90 Ball Lift which includes a pair of tubular track members, and the Brunswick Subway Power Lift assembly which makes use of a pair of conventional tracks with wear strips which may be replaced when worn.

While each of the foregoing inventions may be suitable for their intended purposes, one common disadvantage is that the dual or pair of track members are difficult to remove and replace when worn. Additionally, since there are always a pair of track members used in conjunction with a lifting mechanism, excessive wear on one track member may require that the pair be replaced as even the slightest amount of uneven wear between the track members can create problems for effectively lifting the bowling ball.

SUMMARY OF THE INVENTION

In accordance with the present invention, a ball lift device is provided which includes an improved track structure for stabilizing the ball along a path of travel as it is lifted within the device. In its simplest form, the ball lift device includes a means for lifting a bowling ball by use of a pair of rotating V wheels. A drive means imparts a spinning action on the V wheels through a drive belt which is driven by a motor. The V wheels are housed within a frame which has an entrance point for receiving a bowling ball to be lifted, and an exit point which ejects the ball at a specified height. A guide support or single track defines the path of travel in which the ball is lifted through the device. When viewed as a whole, the guide support is an S-shaped member having two components, namely, a guide support bracket and a wear strip mounted over the bracket. The ball travels along the wear strip and substantially along a center line of the width of the wear strip. In the preferred embodiment, the guide support comprises an upper guide support and a lower guide support which, when assembled within the ball lift device, have an opposite curvature resulting in the overall S-shape. A pair of side wear strips extend along the path of travel and are positioned so as to laterally stabilize the bowling ball as it is lifted along the guide support. Accordingly, the side wear strips contact the ball at approximately 180° from one another and 90° from the guide support. The guide wear strip is a flat surface when viewed along a line extending along the width of the wear strip.

The guide wear strip is secured to its corresponding bracket by a plurality of rivets or nut and bolt combinations. Accordingly, the guide wear strip can be easily replaced when worn without having to disassemble other parts of the ball lift device. The side wear strips are also easily replaced as they are also mounted to the frame by rivets or some other removable fastening means.

Because the surfaces which contact the bowling ball can be replaced without disassembling other major components of the ball lift device, the device is more easily maintained. Additionally, the guide wear strip and side wear strips are much less expensive to replace than the dual tracks found on the prior art devices.

Since the bowling ball is stabilized at three points (i.e., at the opposed side wear strips and the guide support) and is contacted at two additional points by a lifting means which opposes the guide support, there is much less "slop" in lifting the ball which, in turn, reduces the amount of wear which the contacting members experience. Many prior art devices which utilize a pair of tracks and a lifting means had a certain amount "slop" which allowed the bowling ball to be randomly displaced along the path of travel. This random displacement would result in uneven wear of the tracks and additional stress placed on the device by an unstable and moving bowling ball which is able to produce higher live loads.

Additionally, since the bowling ball is placed in a more stable position as it is lifted through the device, there is less chance that the ball will become nicked by contacting members within the device which, in turn, increases the life of the bowling ball.

Each of the foregoing advantages of this invention are achieved with a relatively simple lift structure which may be manufactured and installed at a minimum cost.

Additional advantages of this invention will become apparent from the description which follows, taken in conjunction with the accompanying drawings.

BEST MODE FOR CARRYING OUT THE INVENTION

Figure 1:
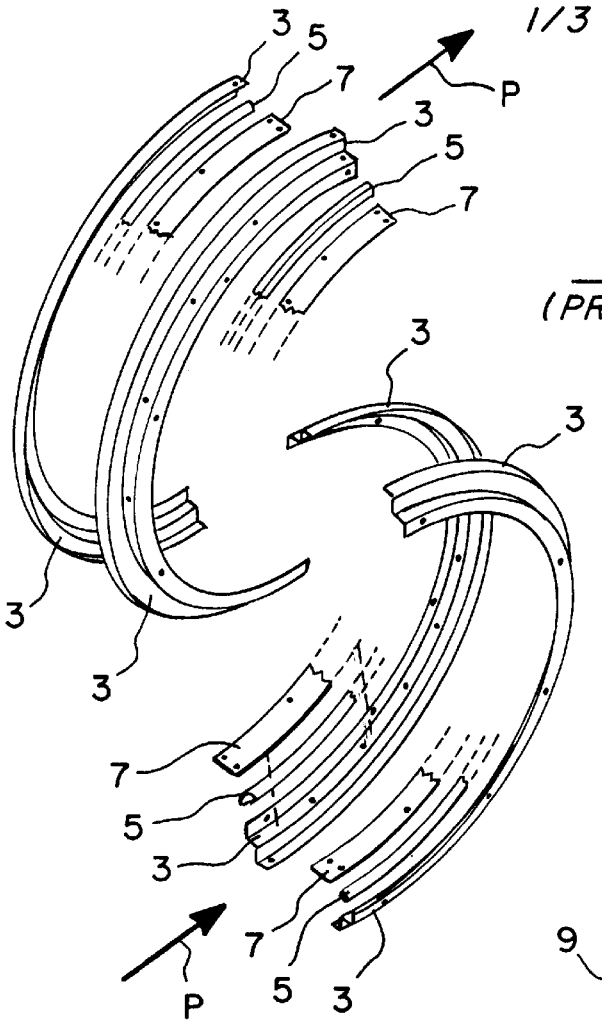
Fig. 1 (PRIOR ART)
FIG. 1 is an exploded perspective view of a pair of track members representative of the prior art and specifically utilized in a commercially available ball lift device manufactured by Brunswick Corporation of New Jersey and known as the Subway Power Lift Assembly.

FIG. 1 illustrates one example of track members utilized in a prior art device for lifting a bowling ball. This particular configuration may include a pair of upper and lower rails 3, and a pair of wear strips 7 which overlie a rubber or otherwise flexible wedge or panel 5. Accordingly, the contacting surface for a bowling ball traversing along rails 3 are the wear strips 7 which mount to the rails 3. The ball enters a device housing the rails 3 along path P and is ejected at an elevated level as the ball travels in the same direction in which it entered the machine.

Figure 2:
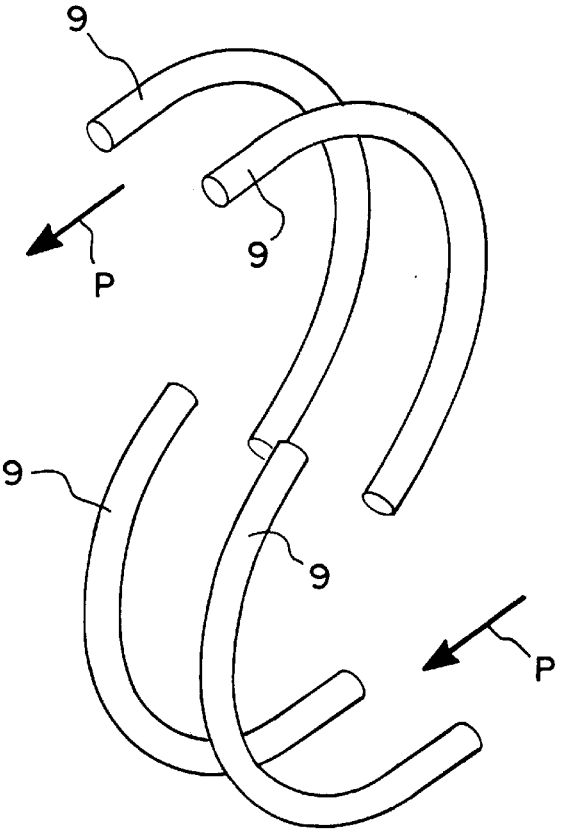
Fig. 2 (PRIOR ART)
FIG. 2 is another perspective view of a pair of track members representative of the prior art and specifically utilized in a ball lift device manufactured by Century International of Golden, Colo., and known as the C-90 Ball Lift.

FIG. 2 illustrates another example of a pair of track members used in a ball lift device. FIG. 2 shows tubular shaped tracks 9 which contact the ball as it is lifted through the machine along path P. As discussed above, these track configurations of FIGS. 1 and 2 may be adequate; however, one major disadvantage is that the wear experienced by the track members usually requires replacement of both tracks.

Figures 3, 5:
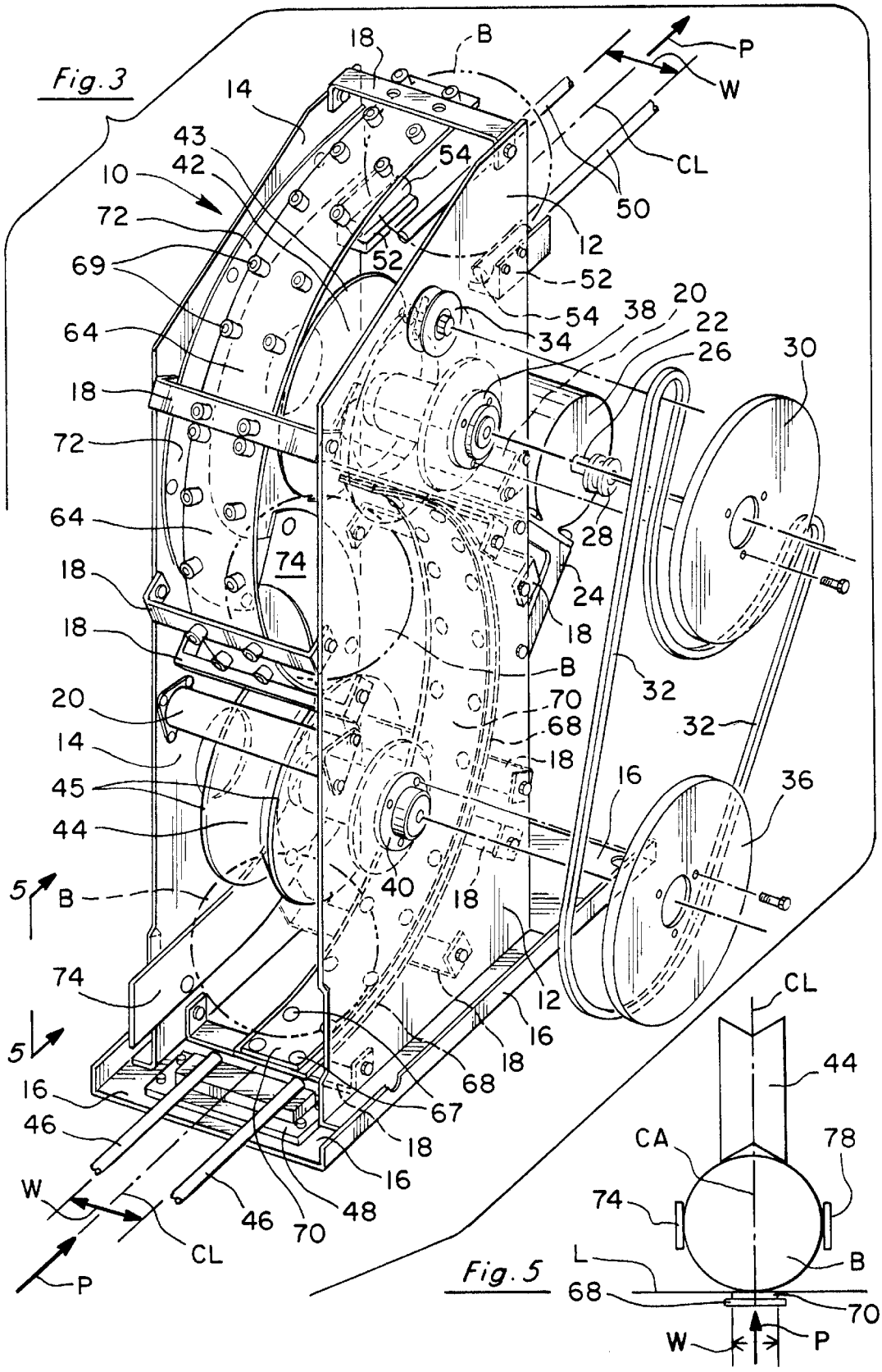
FIG. 3 is a partially exploded perspective view of the ball lift device of this invention.
FIG. 5 is a reduced vertical section, taken line 5—5 of FIG. 3, illustrating how the bowling ball is contacted by the ball lift device as it is lifted therethrough.

As shown in FIG. 3, the ball lift device 10 of this invention receives a bowling ball B along a path of travel P, lifts the bowling ball to a specified height, and then ejects the ball for access by a bowler. In a preferred embodiment, the structure of the ball lift device 10 includes a right side plate 12 and a left side plate 14 which are mounted to a base plate 16. A plurality of rectangular cross supports 18 and a pair of opposing tubular cross supports 20 are used to stabilize the right and left side plates 12 and 14 a specified distance from one another.

A drive motor 22 is mounted to the exit side of the ball lift device by a motor mount 24 which attaches to the left and right side plates. The drive motor includes a drive shaft 26 which has a drive pulley 28 mounted thereover. A drive belt 32 engages drive pulley 28 to impart a spinning motion on both the upper V wheel pulley 30 and lower V wheel pulley 36. An idler 34 is mounted to the right side plate 12 and may be adjusted in a vertical direction in order to adjust the tension of drive belt 32. Upper V wheel pulley 30 mounts to one end of upper shaft assembly 38. Similarly, lower V wheel pulley 36 mounts to one end of lower shaft assembly 40. Upper and lower shaft assemblies 38 and 40 extend through openings formed in the right side plate 12. The opposite end of upper shaft assembly 38 mounts to upper V wheel 42. Similarly, the opposite end of lower shaft assembly 40 mounts to lower V wheel 44. Both upper and lower V wheels 42 and 44 include engaging surfaces 43 and 45, respectively, which engage the bowling ball at two spaced points. As shown in FIG. 3, when the ball lift device is assembled, the upper and lower V wheels 42 and 44 are disposed vertically from one another.

As shown in FIG. 3, a bowling ball may enter the ball lift device 10 upon entrance tracks 46 which terminate at the entrance of the ball lift device. Entrance tracks 46 may be supported on an entrance track support 48 which itself may be mounted to base plate 16. After the ball has been lifted in the ball lift device 10, a pair of exit tracks 50 may be provided to allow the bowling ball to be ejected for access by a bowler. Near the exit end of the ball lift device are a pair of transition pads 54 which are mounted on transition pad mounts 52. These transition pads 54 are placed at an elevation higher than exit tracks 50 and further assist in stabilizing any random lateral movement of the bowling ball prior to ejection on exit tracks 50. As shown, transition pad mounts 52 are attached to the interior surfaces of left and right side plates 12 and 14.

The structure previously described is common to many ball lift devices which have an S-shape path of travel for lifting a bowling ball to a desired height. For example, the Century C-90 Ball Lift and the Brunswick Subway Power Lift Assembly both utilize similar structure.

Figure 4:
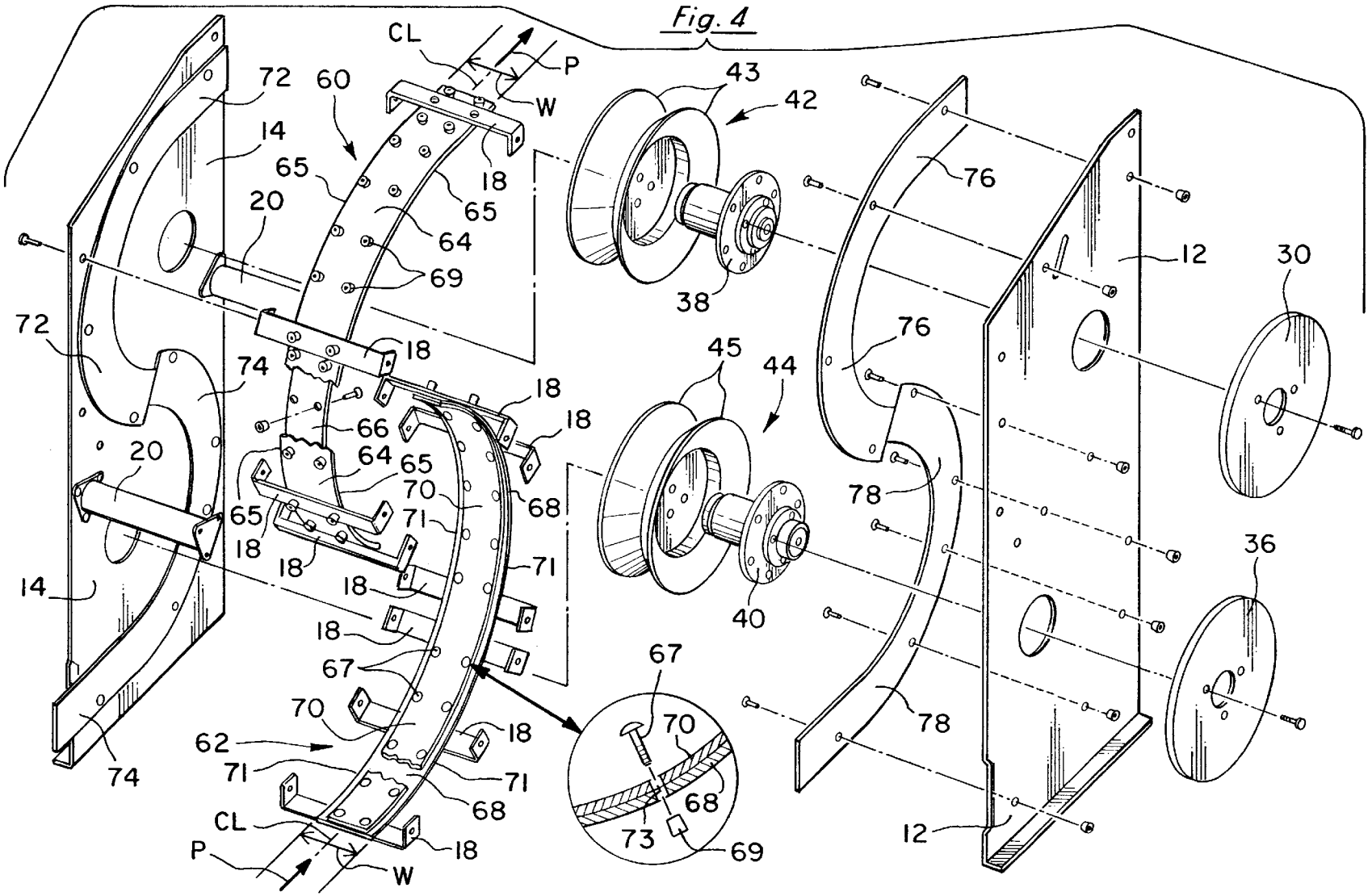
FIG. 4 is an exploded perspective view of some of the primary elements making up the ball lift device and specifically illustrating the guide supports and side wear strips.

FIG. 4 illustrates an upper guide support assembly 60 and a lower guide support assembly 62 which guide the bowling ball as it is lifted through the ball lift device. As shown, the upper guide support assembly 60 is characterized by an upper guide support bracket 64 which is secured within the ball lift device by mounting to cross supports 18. Upper guide support bracket 64 has a generally curved shape and terminates at its upper end in a horizontal extension for ejecting the bowling ball along exit tracks 50. The lateral sides of upper support bracket 64 are defined by side edges 65. Mounted between side edges 65 is a continuous upper guide support wear strip 66. Wear strip 66 extends substantially the length of support bracket 64 and is placed on the interior side of bracket 64 to contact the bowling ball.

The lower guide support assembly 62 includes a lower guide support bracket 68 and a lower guide support wear strip 70 mounted thereover and between lower guide support side edges 71. Wear strip 70 also extends substantially the length of its corresponding bracket 68 and is placed on the interior side to contact the bowling ball. The upper and lower wear strips 66 and 70 may be mounted to their corresponding brackets by any number of well-known types of conventional fastening means such as a bolt and nut combination, or as shown in the magnified portion of FIG. 4 by an anchor or fastener 67 which is inserted through an aligned opening 73 in a wear strip and its bracket, and secured by cap 69. When the upper guide support assembly 60 and lower guide support assembly 62 are mounted within the ball lift device 10, they result in an S-shape configuration. The curvatures of these members allow placement of the V wheels 42 and 44 in a vertically aligned position. When viewing the lifting of a bowling ball within the device from the right side plate 12, the ball enters the device at the lower left, is elevated and initially rotates in a counterclockwise direction, then continues to be lifted but is then rotated in a clockwise direction and exits at the upper right of the device.

A pair of opposing side wear strip members are attached to the left and right side plates 12 and 14 as shown in FIG. 4. More specifically, upper left side wear strip 72 and lower left side wear strip 74 are attached to left side plate 14, and upper right side wear strip 76 and lower right side wear strip 78 attach to right side plate 14. The upper right and lower right side wear strips 76 and 78 have been deleted from FIG. 3 in order that one may better view the travel of a bowling ball through the device. These side wear strips may be attached to the left and right side plates in the same manner as the guide support wear strips 66 and 70 attach to their corresponding brackets. Those skilled in the art can envision other ways in which the wear strips may be secured for easy replacement. Therefore, although the preferred embodiment illustrates a nut and bolt or anchor and cap combination, this invention covers other ways of attachment which allows easy removal of the wear strips.

FIG. 5 illustrates the arrangement of the side wear strips with respect to a guide support wear strip. As shown, side wear strips 74 and 78 are positioned substantially perpendicular to guide wear strip 70. Accordingly, the side wear strips contact substantially opposite sides of the bowling ball and the guide wear strip contacts the bowling ball approximately 90° from either one of the side wear strips. As shown in FIGS. 3 and 5, a guide support wear strip may be further defined as having a width W which extends normal to the path of travel P and in which the wear strip extends at least across a centerline CL of the path of travel. The centerline CL substantially aligns with a center axis CA of the bowling ball. The wear strip may be further characterized as having a flat surface as viewed along a line L which traverses or extends along the width W.

Although FIG. 5 illustrates the side wear strips touching the opposite sides of the bowling ball, it shall be understood that a slight gap may be desirable between the opposing sides of the bowling ball and the side wear strips in order to avoid unduly constraining the bowling ball as it is lifted through the device. Additionally, since not all bowling balls are of the same diameter, some clearance must exist to accommodate the differing sized balls. In any event, the contact of at least one side wear strip against the bowling ball as it is lifted through the device will greatly reduce undesirable lateral shifting or displacement that may occur as the bowling ball is lifted through the device.

Furthermore, although continuous guide support wear strips are shown, it may also be desirable to divide the guide support wear strip into longitudinal sections or segments so that only those sections which become excessively worn need to be replaced. For example, a first section of a guide support wear strip may experience undue wear while a second section may experience very little wear. Accordingly, only the first section of the guide support wear strip would need to be replaced.

Because the force of the bowling ball is primarily placed upon the guide support wear strip which is aligned along the central axis CA of the bowling ball, such an aligned contact area is less likely to impart undesirable lateral movement on the ball. In other words, since there is a single line of contact at which the center axis of the ball places most of its force with respect to a contacting member in the lifting device, the ball will naturally maintain a more true and straight path of travel through the device. In prior art devices which utilize dual track members, even the slightest uneven wear of a track member can cause an irregular contacting surface as the ball traverses through the lifting device resulting in an undesirable lateral displacement or spinning of the ball. Since the side wear strips do not receive the full load or weight of the ball as it travels through the device, the contact of the bowling ball against the side wear strips serves to stabilize the bowling ball in its path of travel with a minimum amount of lateral deflection by contact of the bowling ball against the side wear strips.

Additionally, since the V wheels substantially oppose the guide wear strip in terms of containing an opposite side of the bowling ball, this opposed relation between the guide wear strip and the contacting surfaces of the V wheels also helps to ensure that the bowling ball does not randomly displace in a lateral direction. Furthermore, the combination of the side wear strips, guide support wear strip, and the contacting surfaces of the V wheels provide aligning structure on four sides of the bowling ball. Accordingly, "slop" is minimized and the bowling ball may be effectively lifted through the device.

This invention has been described in detail with reference to a particular embodiment thereof, but it will be understood that various modifications can be effected within the spirit and scope of this invention.

We claim:

1. A ball lift device for lifting a bowling ball to a desired level, said ball lift device comprising:

a frame for supporting said ball lift device;

means for lifting the ball housed within said frame, said lifting means including laterally spaced ball engaging surfaces for contacting and lifting the bowling ball and to assist in maintaining the ball along a center line of a guide path of travel;

drive means cooperating with said lifting means to power said lifting means in order to lift the bowling ball; and a first guide support connected to said frame for supporting the bowling ball as it is lifted through said ball lift device, said first guide support including opposed side edges and a wear strip mounted between said opposed side edges, said wear strip contacting the ball as it is lifted through the device, said wear strip defining the guide path having a width, said width extending normal to the path of travel of the bowling ball, said wear strip extending across the center line of said guide path and said wear strip further having a flat surface when viewed along a line extending along said width, said wear strip being positioned in opposed relation to said laterally spaced ball engaging surfaces to contact an opposite side of the bowling ball.

2. A device, as claimed in claim 1, wherein:

said wear strip has a curved shape when viewed along a side edge of said opposed side edges.

3. A device, as claimed claim 1, further including:

a first side wear strip mounted within said frame and placed adjacent a first side edge of said opposed side edges; and a second side wear strip mounted within said frame and placed adjacent a second side edge of said opposed side edges, said first and second side wear strips extending along said guide path to stabilize the bowling ball as it is lifted through said ball lift device.

4. A device, as claimed in claim 2, further including:

a second guide support connected to said frame and communicating with said first guide support, said second guide support forming an extension of said guide path, said second guide support having an opposite curved shape in comparison with said curved shape of first guide support.

5. A ball lift device for lifting a bowling ball to a desired level, said ball lift device comprising:

a frame for supporting said ball lift device;

means for lifting the bowling ball and housed within said frame, said lifting means including laterally spaced ball engaging surfaces for contacting and lifting the bowling ball and to assist in maintaining the ball along a center line of a guide path of travel;

drive means cooperating with said lifting means to power said lifting means in order to lift the bowling ball; and a wear strip mounted to said frame and being positioned in opposed relationship to said laterally spaced ball engaging surfaces to contact an opposite side of the bowling ball, said wear strip having opposed side edges and a width extending normal to the path of travel of the bowling ball, said wear strip extending across the center line of the path of travel and said wear strip maintaining contact with the bowling ball as it is lifted through the device.

6. A device, as claimed in claim 5, wherein:

said wear strip has a flat surface when viewed along a line extending along said width.

7. A device, as claimed in claim 5, wherein:

said wear strip has a curved shape when viewed along a side edge of said opposed side edges.

8. A device, as claimed in claim 5, wherein:

said wear strip has an S-shape when viewed along a side edge of said opposed side edges.

9. A device, as claimed in claim 5, further including:

a first side wear strip mounted within said frame and placed adjacent a first side edge of said opposed side edges; and a second side wear strip mounted within said frame and placed adjacent a second side edge of said opposed side edges, said first and second side wear strips extending along side the path of travel to stabilize the bowling ball as it is lifted through said ball lift device.

10. In a ball lift device which lifts a ball to a desired level for extraction by a bowler in which the ball lift device includes means for lifting the bowling ball and drive means cooperating with said lifting means to power said lifting means, the ball being lifted along a path of travel within the device, the improvement comprising:

a wear strip having opposed side edges, a curved length and a width extending normal to a path of travel of the bowling ball, said width extending across a center line of the path of travel and wherein the center line is aligned along a center axis of the bowling ball as the bowling ball is lifted along the path of travel and in contact with said wear strip; and;

said lifting means includes laterally spaced ball engaging surfaces positioned in opposed relationship to said wear strip to contact an opposite side of the bowling ball.

11. A device, as claimed in claim 10, wherein:

said wear strip has a flat surface when viewed along a line traversing said width.

12. A device, as claimed in claim 10, wherein:

said wear strip has an S-shape.

13. A device, as claimed in claim 10, further including:

a pair of side wear strips mounted within said frame adjacent said wear strip to stabilize the bowling ball as it is lifted through said ball lift device and along the path of travel.

* * * * *